US005666676A

United States Patent [19]

Roemen et al.

[11] Patent Number: 5,666,676

[45] Date of Patent: Sep. 16, 1997

[54] BATHROOM CABINET WITH PERSONAL HYGIENIC COMPONENTS

[76] Inventors: Arlen M. Roemen, 325 Dellwood Dr., Eugene, Oreg. 97405; William F. Glenn, 1780 Bruer La., Eugene, Oreg. 97401

[21] Appl. No.: 513,459

[22] Filed: Aug. 10, 1995

[51] Int. Cl.[6] ..... A47K 3/22

[52] U.S. Cl. ..... 4/443; 4/448

[58] Field of Search ..... 4/420.2, 443, 448, 4/567

[56] References Cited

U.S. PATENT DOCUMENTS

| | | | |
|---|---|---|---|
| 2,241,823 | 5/1941 | McFarland et al. | 4/448 X |
| 3,210,141 | 10/1965 | Thomas | 312/209 |
| 3,281,195 | 10/1966 | Showmes | 312/209 |
| 3,662,407 | 5/1972 | Colucci | 4/420.2 |
| 4,189,195 | 2/1980 | Turney et al. | 312/209 |
| 5,090,067 | 2/1992 | Cogdill | 4/420.2 |
| 5,160,197 | 11/1992 | Klose | 4/605 X |
| 5,295,274 | 3/1994 | Daniels et al. | 4/443 |

FOREIGN PATENT DOCUMENTS

| | | | |
|---|---|---|---|
| 2061934 | 3/1993 | Canada | 4/443 |
| 0913242 | 9/1946 | France | 4/567 |
| 0766508 | 1/1957 | United Kingdom | 4/567 |
| 1535794 | 12/1978 | United Kingdom | 4/448 |

*Primary Examiner*—Robert M. Fetsuga
*Attorney, Agent, or Firm*—James D. Givnan, Jr.

[57] ABSTRACT

A cabinet in a bathroom wall receives hot and cold water flows with a mixing valve in the cabinet serving to additionally provide an on-off control. A flexible conduit is provided with a hand grip removably held in place in the cabinet so as to position a nozzle of the hand grip over an outlet for discharge of a preliminary water flow for temperature testing purposes. A thermometer is served by a sensor responsive to the temperature of a mixed flow and provides a readout to the user. Testing of water temperature may also be achieved by touch.

1 Claim, 1 Drawing Sheet

BATHROOM CABINET WITH PERSONAL HYGIENIC COMPONENTS

BACKGROUND OF THE INVENTION

The present invention pertains generally to systems, fixtures, etc., for use in a bathroom for personal hygiene.

Fixtures currently utilized in bathrooms include bidets which are quite costly particularly from the plumbing effort incurred. Additionally most bathrooms, especially in older homes, lack the space for installation of a bidet.

Existing portable items for personal hygiene are difficult to store in a compact, tidy manner. Attempts to overcome such problems are found in U.S. Pat. Nos. 3,210,141 and 3,281,195 while U.S. Pat. No. 4,189,195 is directed toward the storage of personal hygiene items. The known prior art teaches the provision of wall mounted cabinets with receptacles filled from a remote source or by a faucet plumbed into a cabinet wall to provide hot and cold water sources but with no means being provided to ensure a flow rate and temperature control.

SUMMARY OF THE PRESENT INVENTION

The present invention is embodied in a bathroom cabinet having components providing a controlled water flow to a conduit with a spray nozzle.

The cabinet is preferably inset in a bathroom wall adjacent a toilet to facilitate convnient adjustment of the control means provided. A water temperature display is provided. A hose is housed in the cabinet to allow water temperature to stabilize at the desired temperature before use of the device. A pressure balanced mixing valve prevents sudden temperature changes while a thermometer indicates a temperature at a current valve setting which may be unaffected by on-off positioning of the valve control.

Important objectives of the present invention include the provision of a cabinet which houses a flexible conduit fitted with a nozzle which may be stowed in a position in a cabinet so as to direct a discharge flow from the nozzle into a receptacle and drain opening in the housing until a desired water temperature has been reached; the provision of a cabinet with a temperature sensor and thermometer to provide the user with a readout of current temperature of a mixed hot and cold water flow; the provision of a bathroom cabinet for hygienic uses having a pressure balanced mixing valve to avoid sudden temperature changes in the water flow.

DETAILED DESCRIPTION OF THE PREFERRED EMBODIMENTS

Figure 1:
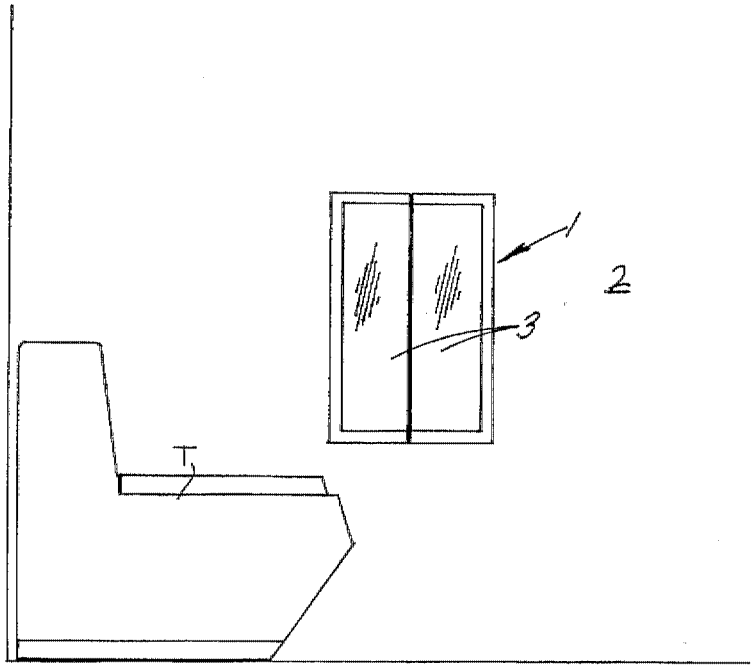
FIG. 1 is an elevational view of the present cabinet installed in a bathroom wall.

With continuing attention to the drawings, wherein applied reference numerals indicate parts similarly hereinafter identified, the reference numeral 1 indicates generally the present cabinet in place in a bathroom wall 2. Cabinet 1 includes a closure 3 which may be a pair of doors.

Figure 2:
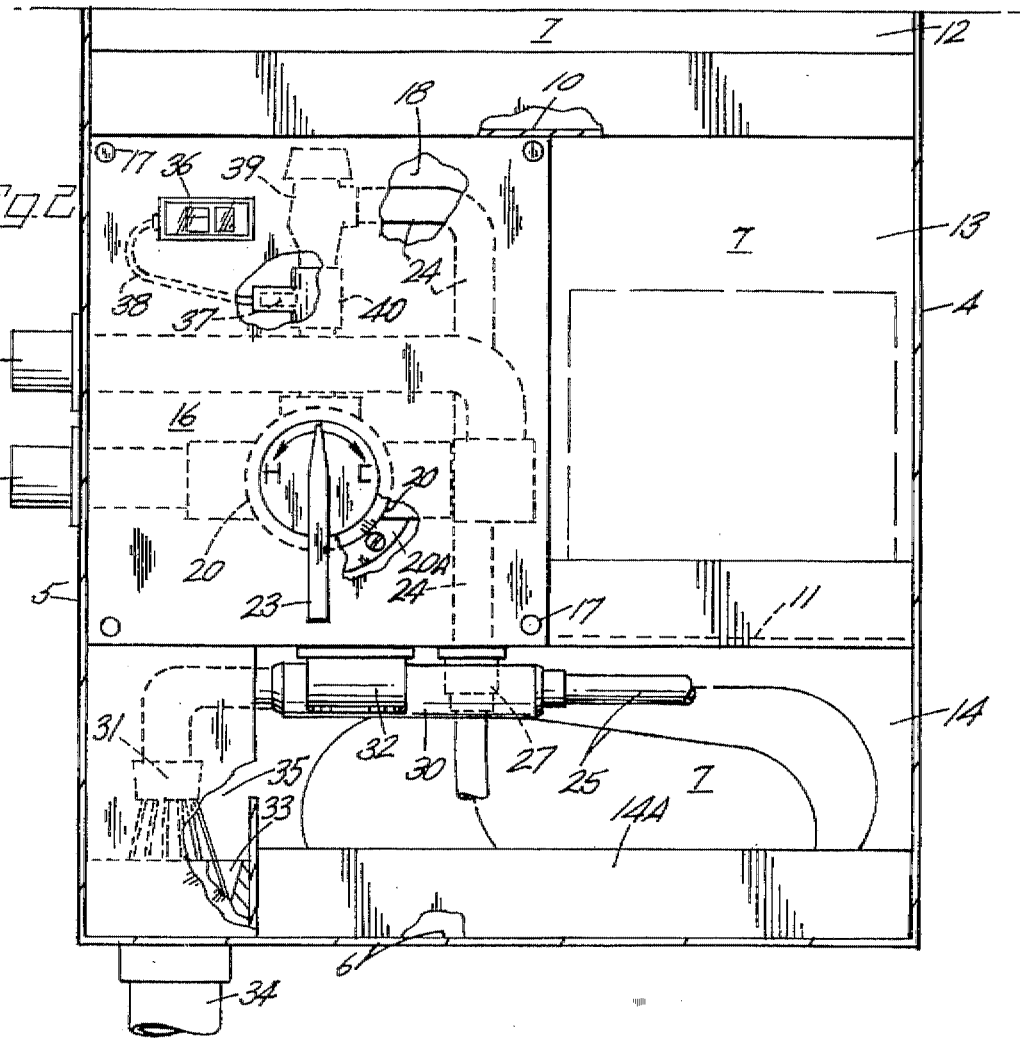
FIG. 2 is a fragmentary elevational view of the cabinet removed from the wall and with the doors detached.

With attention to FIG. 2, the cabinet comprises sidewalls 4 and 5, a bottom wall at 6 and a top wall (not shown). A rear wall is at 7 contiguous with the above mentioned walls. Shelves at 10 and 11 along the top an bottom walls define storage areas at 12, 13 and 14. The number and shape of storage areas and their sizes may be varied to best suit current needs. A panel 16 is affixed to the frontal portion of the cabinet by fasteners 17 and provides a closure for an area 18 which receives the following described components. Hot and cold water inlets at 21 and 22 terminate in connection with a valve 20. A valve control or handle 23 is located immediately forward of panel 16. Valve 20 is preferably a mixing valve of the pressure balanced type as heretofore commonly used as a shower valve and maintains a constant outlet temperature regardless of pressure changes in the hot and cold inlets 21 and 22. Additionally an off-on function of the valve 20 is controlled by inwardly and outwardly directed forces manually applied to handle 23. Valves of the above described type are well known in the plumbing trade and accordingly no further description of same is believed necessary. An outlet conduit 24 communicates valve 20 with a hose via a coupling 27. Hose 25 is flexible to the extent it may be shaped in serpentine manner for compact storage in cabinet defined area 14. A lip 14A confines the hose in said area. A hand grip 30 on hose 25 includes a nozzle 31 and is preferably of L-shape and facilitates removal and storage of hose 25.

Hand grip 30 is removably positioned in a holder 32 which may be a flexible clip affixed in place on shelf 11 to facilitate convenient reception and removal of hand grip 30. Holder 32 preferably also serves to locate nozzle 31 for fluid discharge into a drain opening 33 which may be located subjacent the nozzle in a fluid discharge chamber 35. Accordingly, with hand grip 30 in place in holder 32 and upon opening of valve 20, a water flow may be directed into drain opening 33 in communication with a drain pipe 34 which discharges into a sanitary sewer line via a P-trap. Alternatively, a preliminary water flow may be otherwise discharged into a wash basin, toilet, etc., to permit dispensing with the drain opening.

A thermometer at 36 is supported by cover plate 16 to provide a visable display of water temperature to the user. A temperature sensor 37 transmits a reading to the thermometer by a cable 38. Sensor 37 is received within a fitting 40 in place on conduit 24. Outlet conduit 24 may be equipped with a vacuum breaker as commonly required by most plumbing codes. Thermometer 36 may provide its own power source such as a 1.5 volt battery. The vacuum breaker is indicated at 39.

In operation, with hand grip 30 in place within holder 32 and upon opening of valve 20, a water flow will flow through conduit 24, hose 25 and ultimately nozzle 31 for discharge into opening 33 and drain pipe 34 or directly into another receptacle as noted above. Thermometer 36 will display water temperature passing throught conduit 24 and which may be controlled upon rotational positioning of valve control 23. Subsequent to a desired temperature being attained valve control 23 is pushed inwardly to close the valve permitting removal of hand grip 30 from holder 32 and from the cabinet permitting positioning of nozzle 31 by the user on a toilet T. The water flow, at the desired temperature, is then resumed by outward displacement of control 23 the extent of such positioning typically determines the flow rate. Subsequent to use, the valve 20 is closed and hand grip 30 reinstalled in holder 32 with any water discharged thereafter draining into drain pipe 34. Water temperature may be tested by the user placing a finger in chamber 35 below nozzle 31.

An anti-siphon vacuum breaker at 39 prevents any back-siphonage in hose 25.

Valve 20 may be mounted on cabinet rear wall 7 by a mounting flange at 20A.

While we have shown but one embodiment of the invention, it will be apparent to those skilled in the art that the invention may be embodied still otherwise without departing from the spirit an scope of the invention.

Having thus described the invention, what is desired to be secured by a Letters Patent is:

We claim:

1. In combination, a bathroom cabinet, a mixing valve for communication with hot and cold water inlets, said valve mounted in place on said cabinet, an outlet conduit in upstream communication with said valve, a heat sensor in place on said outlet conduit and a thermometer having a visual display in place on said cabinet and responsive to a mixed flow of hot and cold water in said outlet conduit, a hose normally housed in the cabinet served by said outlet conduit and having a hand grip and nozzle, a fluid discharge chamber in said cabinet to receive water discharged from said nozzle, a drain opening in said cabinet below said discharge chamber and drain pipe in communciation with said drain opening for reception of a water flow from said nozzle for discharge into the drain system of a bathroom, and a holder in place in said cabinet for reception of the hand grip and positioning said hand grip and nozzle for water discharge into said chamber whereat the user may manually test water flow temperature prior to the water entering the drain opening and permitting removal of the hand grip and nozzle from the interior of the cabinet.

* * * * *